US010182670B2

(12) United States Patent
Pretotto

(10) Patent No.: US 10,182,670 B2
(45) Date of Patent: Jan. 22, 2019

(54) MODULAR VAPE GEAR SHELF AND STORAGE

(71) Applicant: Joseph Pretotto, Vaughan (CA)

(72) Inventor: Joseph Pretotto, Vaughan (CA)

( * ) Notice: Subject to any disclaimer, the term of this patent is extended or adjusted under 35 U.S.C. 154(b) by 0 days.

(21) Appl. No.: 15/958,074

(22) Filed: Apr. 20, 2018

(65) Prior Publication Data

US 2018/0303254 A1 Oct. 25, 2018

Related U.S. Application Data

(60) Provisional application No. 62/487,546, filed on Apr. 20, 2017.

(51) Int. Cl.

| | |
|---|---|
| ***A47F 7/00*** | (2006.01) |
| ***A24F 21/00*** | (2006.01) |
| ***A47F 5/00*** | (2006.01) |
| ***A47F 5/10*** | (2006.01) |

(52) U.S. Cl.

CPC ..... *A47F 7/00* (2013.01); *A24F 21/00* (2013.01); *A47F 5/0018* (2013.01); *A47F 5/10* (2013.01)

(58) Field of Classification Search

CPC ..... A47F 7/00; A47F 7/0028; A47F 7/283; A47F 7/286; A47F 3/14; A47F 5/0018; A47F 5/10; A47F 5/112; A47F 5/0062; A47F 5/00; A47F 5/0025

USPC ..... 211/72, 74

See application file for complete search history.

(56) References Cited

U.S. PATENT DOCUMENTS

| | | | | | |
|---|---|---|---|---|---|
| 1,473,868 | A | * | 11/1923 | Pinten | A47F 3/005 211/55 |
| 1,497,456 | A | * | 6/1924 | List | A47F 5/112 108/100 |
| 1,609,945 | A | * | 12/1926 | Hermani | A47F 3/14 211/135 |
| 1,610,834 | A | * | 12/1926 | Webster | A47F 7/146 206/446 |
| 1,791,417 | A | | 2/1931 | Lilienfield | |
| 1,918,329 | A | * | 7/1933 | Gore | A47F 5/00 211/128.1 |
| 2,251,814 | A | * | 8/1941 | Yohns | A47F 5/10 211/130.1 |
| 2,307,992 | A | * | 1/1943 | Calhoun | A47F 5/112 206/733 |

(Continued)

FOREIGN PATENT DOCUMENTS

CN 203724390 U 7/2014

*Primary Examiner* — Patrick D Hawn

(74) *Attorney, Agent, or Firm* — William J. Clemens; Shumaker, Loop & Kendrick, LLP

(57) ABSTRACT

A modular system for displaying and/or storing vaping products is provided. The system has a base plate and at least two support members. The support members can be removably attached to the base plate. A back plate and a plurality of shelving plates are also provided. The shelving plates can be removably attached to the support members at different heights and at least one of the shelving plates is angled so that vaping products stored thereon lean on the front edge of the adjacent shelving plate that is higher or the back plate. At least one of the shelving plates may have apertures for receiving a portion of the vaping products. Specially designed inserts are also provided for adapting atomizers or other vaping accessories to be stored. The inserts may have holes with 510 thread.

8 Claims, 15 Drawing Sheets

(56) References Cited

U.S. PATENT DOCUMENTS

| | | | | | |
|---|---|---|---|---|---|
| 2,355,206 | A * | 8/1944 | Davidson, Jr. | B65D 5/5021 | 206/562 |
| 2,430,166 | A * | 11/1947 | Fish | A47F 5/112 | 211/126.16 |
| 2,677,469 | A * | 5/1954 | Ebert | A47F 5/112 | 211/73 |
| 2,914,184 | A * | 11/1959 | Dgetluck | A47F 5/112 | 211/128.1 |
| 2,963,167 | A | 12/1960 | Norman | | |
| 3,774,774 | A | 11/1973 | Menkel | | |
| 4,350,253 | A | 9/1982 | Rusteberg | | |
| 4,907,705 | A | 3/1990 | Waldeck | | |
| 5,312,000 | A * | 5/1994 | Bass | A47F 7/286 | 211/4 |
| 5,499,711 | A * | 3/1996 | Kozak | B65D 5/5023 | 206/372 |
| 6,012,585 | A * | 1/2000 | Parker | A47B 67/02 | 206/538 |
| D420,533 | S | 2/2000 | Pugatch | | |
| 7,591,382 | B2 * | 9/2009 | Brock | A45D 33/26 | 211/10 |
| 7,731,039 | B1 * | 6/2010 | Minger | A47F 7/0078 | 206/423 |
| 8,640,889 | B2 | 2/2014 | Gasper et al. | | |
| 8,967,400 | B1 * | 3/2015 | Mumford | A47F 5/08 | 211/128.1 |
| 9,060,625 | B2 * | 6/2015 | Theisen | A47F 5/0025 | |
| D738,039 | S | 9/2015 | Chen et al. | | |
| 9,101,167 | B2 | 9/2015 | Fath | | |
| 2008/0017596 | A1 * | 1/2008 | Brock | A45D 33/26 | 211/10 |
| 2016/0157606 | A1 | 6/2016 | Kaelin | | |

* cited by examiner

MODULAR VAPE GEAR SHELF AND STORAGE

CROSS-REFERENCE TO RELATED APPLICATIONS

This application claims the benefit of U.S. provisional patent application Ser. No. 62/487,546 filed Apr. 20, 2017.

FIELD OF THE INVENTION

This disclosure relates to the field of display and storage shelves, in particular display and storage shelves for vaping products.

BACKGROUND OF THE INVENTION

Various display and/or storage shelves are known in the art.

U.S. Pat. No. 3,774,774 to Menkel discloses a display stand having a first plate comprising a series of steps and risers and a second plate superimposed on the first plate to define a series of opening receptacles. In some embodiments, the steps slant downwardly away from the front of the display stand.

U.S. Pat. No. 4,907,705 to Waldeck discloses a display case comprising a vertical back portion, lower and upper display racks attached to the vertical back portion. The lower and upper display racks slope downwardly away from the back portion and are supported by a base member which is also connected to the lower portion of the back portion. The upper display rack is provided with apertures to receive items, while the items smaller than the apertures may rest on the lower display rack.

U.S. Pat. No. 8,640,889 to Gasper, et al. discloses a utility storage rack comprising a four-sided frame and a plurality of apertures configured on two opposing side surfaces for receiving and holding objects. The rack has internal support brackets that support the frame and the objects received. There are apertures on the back face for receiving fasteners that secure the frame to a support surface. The front face is also configured with apertures to receive attachments for hanging objects.

U.S. Design Pat. No. D420533 to Pugatch discloses a display holder for retaining cigar tube containers. The display holder has sides with slanted top edge and a shelf with apertures configured thereon for receiving the cigar tube containers.

U.S. Pat. No. 1,791,417 to Lilienfield discloses a cigar container comprising a cylindrical body member having multiple apertures to hold the cigars upright and a cover for closing the top portion of the body member.

U.S. Pat. No. 9,101,167 to Fath discloses a display system for displaying containers, wherein a plurality of apertures is configured in the system to receive and hold the containers.

U.S. Pat. No. 4,350,253 to Rusteberg discloses a bottle storage rack having slanted bottle engaging arm with indentations for receiving the necks of bottles.

US Patent application publication No. 20160157606 to Kaelin discloses an apparatus for having receiving slots for holding and retaining glass articles.

U.S. Pat. No. 2,963,167 to Alexandra discloses a bottle support system having bottle holding assembly and a mounting assembly that allows the bottle holding assembly to be rotated.

U.S. Design Pat. No. D738039 to Chen, et al. discloses an electronic cigarette desktop holder having multiple apertures configured therein for holding electronic cigarettes.

Chinese Utility Model Patent No. 203724390 to Wang et al. discloses an atomizer storage box having a shelf disposed therein, the shelf is configured with holding holes for receiving and holding the atomizer, and a cover for closing the box.

Generally, the display and storage shelves currently available to the public have holes/apertures/openings/indentations of fixed sizes so that they can only accommodate objects of certain sizes. In addition, many of these shelves have complicated structures and/or use significant amount of materials in relation to their displaying and/or storing capacities. Furthermore, some of these shelves have a large footprint, making them more difficult to use.

BRIEF SUMMARY OF THE INVENTION

This disclosure provides a display and storage shelf system, in particular for vaping products, also called vape products. Some examples of the vaping products include atomizers, tanks, rebuildable dripping atomizers (or RDA's), rebuildable tank atomizers (RTA's), sub-ohm tanks, clearomizers, cartomizers, drip tips, etc. The shelf system may remedy some of the deficiencies of the current shelves.

In one aspect, there is provided a display and storage system that may be assembled and disassembled by the end user. Thus, the shelf may take up much less volume when being transported.

In another aspect, the display and storage system for displaying and storing vaping products is adapted for storage and locating of containers for electronic cigarette liquid, drip tips, atomizers and other tools or accessories.

In a further aspect of the invention, there is provided a modular system for displaying and storing vaping products, comprising: a base plate having peripheral side, front and back edges; at least one upright back wall; at least two support members; a plurality of shelving plates, each having shelving plate front, side and back peripheral edges; and at least one back plate; wherein the at least one upright back wall is configured to removably connect to the base plate at the back peripheral edge of the base plate and extending upwardly from the base plate; the at least two support members are configured to removably connect to the side peripheral edges of the base plate, the support members positioned on opposite sides of the base plate, extending upwardly from the base plate, the plurality of shelving plates are configured to removably connect and extend between the at least two support members, and at least one of the plurality of shelving plates extends at an angle above a horizontal plane from front to back, and the back plate is upright and configured to removably connect between the at least two support members at a rear area thereof, such that it extends adjacent and above the shelving plate rear edge allowing vaping products to be placed on the at least one angled shelving plate and be supported by the back plate. In accordance with a further aspect of the invention, the modular system further comprises at least one upper shelving plate positioned above said angled shelving plate, offset rearwardly from said angled shelving plate, such that vaping products resting on said angled shelving plate may rest against a front edge of said upper shelving plate. The upper shelving plate front edge may include contours, recesses and/or apertures configured to receive vape products. The back plate may include recessed portions or apertures adapted to accept portions of the vape products sitting on at least one said angled shelving plate. The shelving plates may be removable as needed to accommodate space requirements.

Additional features and advantages of the system described herein will be set forth in the detailed description that follows, and in part will be readily apparent to those skilled in the art from that description or recognized by practicing the embodiments described herein, including the detailed description that follows, the claims, as well as the drawings.

BRIEF DESCRIPTION OF THE DRAWINGS

Reference will now be made, by way of example, to the accompanying drawings which show example embodiments of the present application, and in which:

FIG. 4 is a perspective view of the system of FIG. 1 with the vaping products displayed and/or stored thereon.

Similar reference numerals may have been used in different figures to denote similar components.

DETAILED DESCRIPTION OF THE INVENTION

In various examples, the present disclosure describes a system for displaying and storing vaping products. The system and the components therein may be of various sizes and/or may comprise different numbers of components suitable for displaying and/or storing different quantities of vaping products. It is understood that the system may be used to store and display other related items.

Referring to FIGS. 1-4, one embodiment of the system for displaying and storing vaping products is shown.

Figure 1:
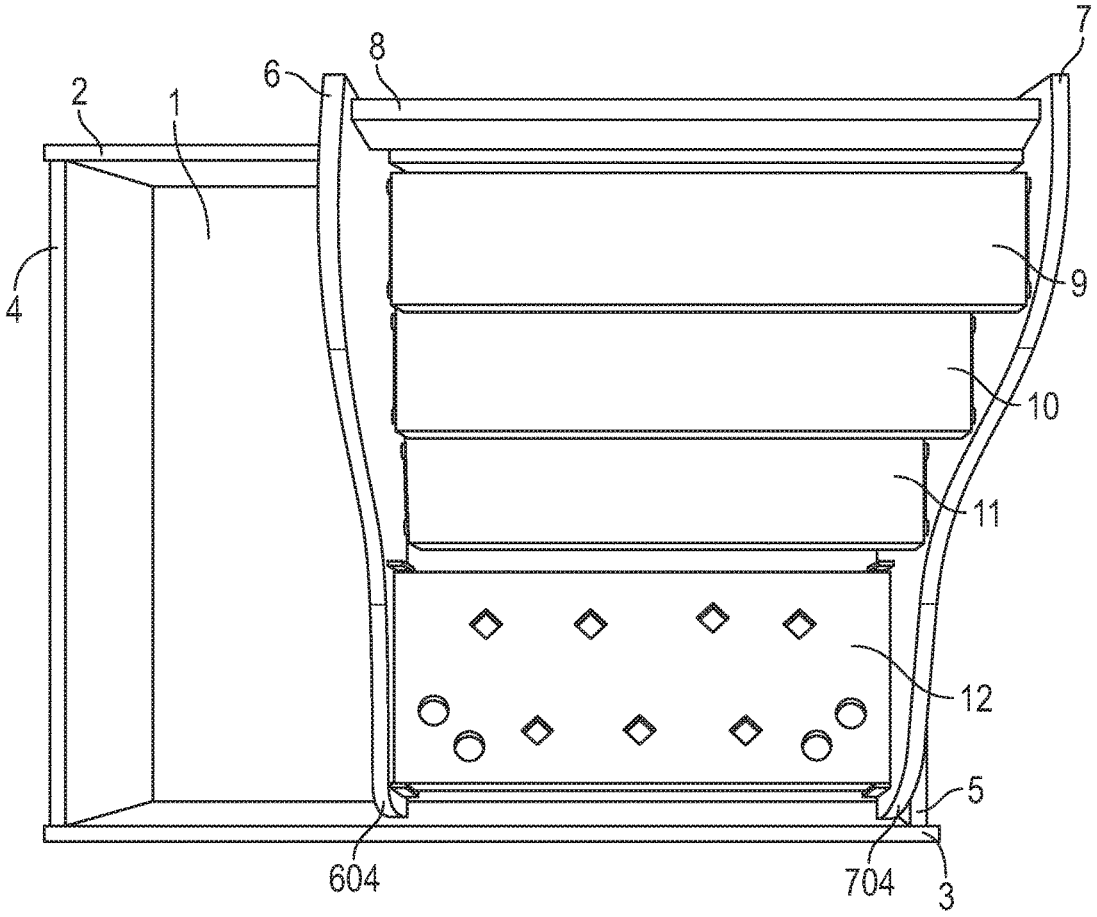
FIG. 1 is a plan view of one embodiment of the system.
Figure 2:
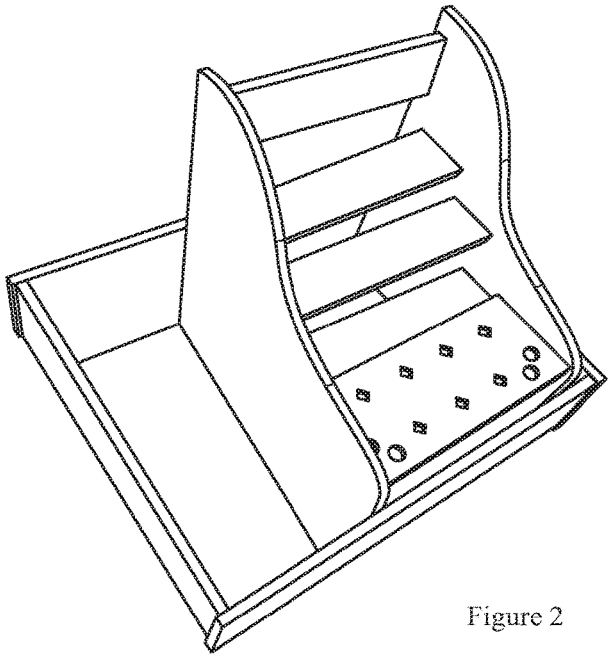
FIG. 2 is a perspective view of the embodiment of FIG. 1.

FIGS. 1 and 2 show a fully assembled system. There is a substantially rectangular base plate 1. Close to the edges of the base plate 1 are front wall 3, back wall 2, and side walls 4, and 5 extending upwardly from the base plate 1. The side walls and the base plate 1 define a space above the base plate 1. In this space are disposed two supporting members 6 and 7, extending upwardly from the base plate 1. In some embodiments, the two supporting members 6 and 7 are substantially parallel to each other. In some embodiments, one of the two supporting members may be close to one of the side walls 4 and 5. As shown in FIG. 1, the supporting member 7 may be close to the side wall 5. In some embodiments, the front edges 604 and 704 of the supporting members 6 and 7 may be close to the front wall 3. It is appreciated that the walls may be substantially vertical or slanted relative to the base plate 1.

In preferred embodiments, the long edges of the base plate 1 are about 300 millimeters long, while the short edges of the base plate 1 are about 225 millimeters long. The front and the back walls are about 300 millimeters long and 45 millimeters tall, while the side walls 4 and 5 are about 211 millimeters long and 45 millimeters tall, the distance between the two support members 6 and 7 is about 155 millimeters and the walls are about 4.76 millimeters thick.

Between the two supporting members are disposed back plate 8, and shelving plates 9, 10, 11 and 12. In some embodiments, at least one of the shelving plates is configured with apertures for receiving and holding the items for displaying and storing. For example, the shelving plate 12 as shown in FIG. 1 is provided with apertures of various sizes and shapes, depending on the item to be displayed and/or stored thereon. Preferably, the shelving plates are disposed between the two supporting members 6 and 7 at different heights and the higher shelving plate is closer to the back plate 8 with the highest shelving plate 9 being the closest to the back plate 8. In preferred embodiments, the plates 8, 9, 10 and 11 are about 150 millimeters long, 40 millimeters wide and 4.76 millimeters thick.

As shown in FIG. 1, there is a further open space defined by the base plate, upright walls and supporting member adjacent the space defined between the two supporting members 6 and 7, and other items may be displayed and/or stored therein.

It is understood that the base plate 1 may be any shape desired, and the number of walls may change correspondingly. It is also understood that there may be more than two supporting members disposed above the base plate 1.

Figure 3:
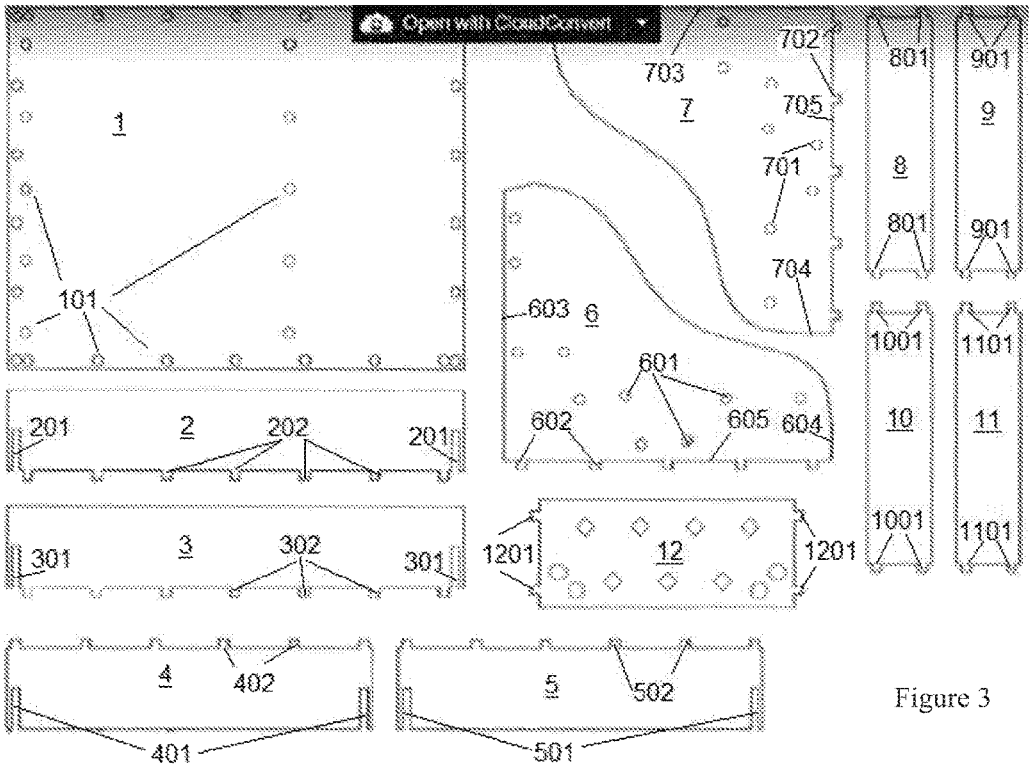
FIG. 3 shows the components for making the system of FIGS. 1 and 2.

FIG. 3 shows the components for making the system shown in FIGS. 1 and 2.

One edge of each of back wall 2, front wall 3, and side walls 4 and 5 is configured to be removably connected to the base plate 1. It is understood that any suitable means known in the field may be utilized to removably connect the walls 2, 3, 4, and 5 to the base plate 1.

In preferred embodiments, the base plate is configured with a plurality of apertures 101 close to its peripheral edges and/or along the line where the support member 6 sits. One edge of each of back wall 2, front wall 3 and the side walls 4 and 5 is configured with protrusions 202, 302, 402 and 502, respectively. The protrusions 202, 302, 402 and 502 are configured to be removably plugged into the apertures 101 along the edges of the base plate 1 to form removable connections. In preferred embodiments, the apertures 101 are cylindrical bores through the base plate 1 with a diameter of about 5.54 millimeters.

The two ends of the back wall 2 are configured to removably connect with one end of each of the side walls 4 and 5. The two ends of the front wall 3 are configured to removably connect with the other end of each of the side walls 4 and 5. The removable connection may be made by any suitable means known in the field.

In some embodiments, the back wall 2 is provided with two slots 201 close to the two ends of the back wall 2, opening in the direction of the protrusions 202. The two slots 201 may be identical to each other. The front wall 3 is provided with two slots 301 close to two ends of the front wall 3, opening in the direction of the protrusions 302. The two slots 301 may be identical. Preferably, the back wall 2 is identical to the front wall 3. Side wall 4 is provided with two slots 401 close to two ends of the side wall 4, opening on the opposite side from the protrusions 402. The two slots 401 are preferably identical to each other. Side wall 5 is provided with two slots 501 close to two ends of the side wall, opening on the opposite side from the protrusions 502. The two slots 501 are preferably identical to each other. The side walls 4 and 5 are preferably identical to each other. When installed, the two slots 401 removably interfere with a slot 201 and a slot 301 to form two removable connections, and the two slots 501 removably engage with a slot 201 and a slot 301 to form two removable connections, thus the four walls are connected along the edges of the base plate 1, defining a space above the base plate 1 as shown in FIGS. 1 and 2.

In some embodiments, the back wall 2, the front wall 3, and the side walls 4 and 5 are substantially planar. In some embodiments, the back wall 2, the front wall 3, and the side walls 4 and 5 and the slots 201, 301, 401 and 501 may be configured in other shapes and sizes. For example, the walls may curve outwardly from their connections to the base plate 1.

Figure 3A:
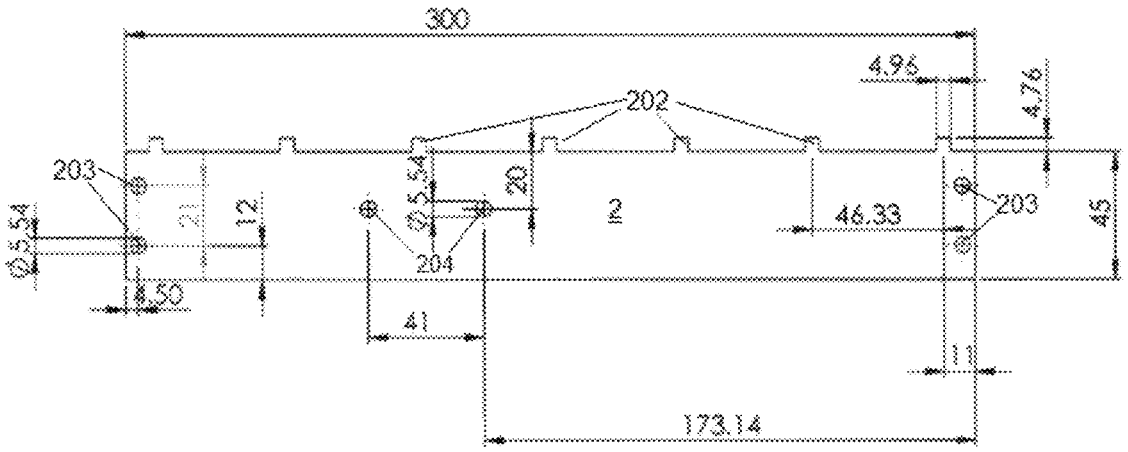
FIG. 3A shows an alternative embodiment of the front and back walls.
Figure 3B:
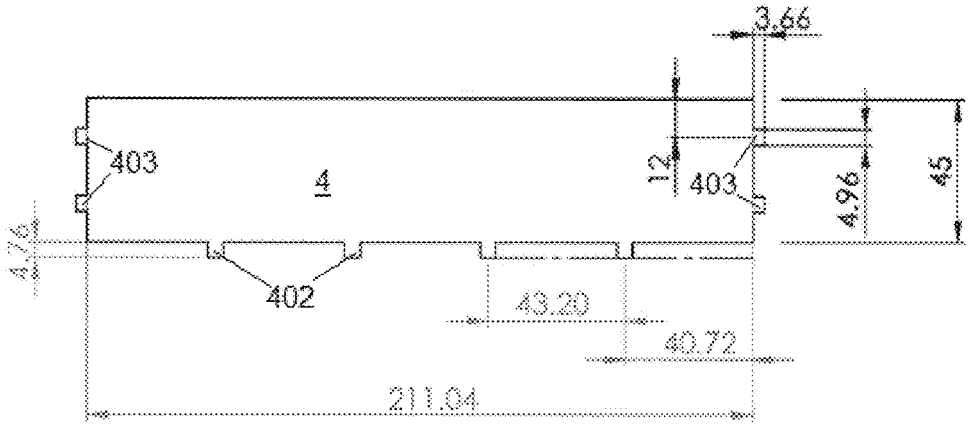
FIG. 3B shows an alternative embodiment the side wall.

In some embodiments, the back wall 2 is not provided with slots 201. Instead, apertures 203 are provided close to the two longitudinal ends of the back wall 2 as shown in FIG. 3A. Correspondingly, the side wall 4 is provided with protrusions 403 close to the two longitudinal ends of the side wall 4, as shown in FIG. 3B. The apertures 203 and the protrusions 403 are so configured that the apertures 203 receive the protrusions 403 to connect the side wall 4 with the back wall 2. The front wall 3 may be identical with the back wall 2 and the other side wall 5 may be identical to the side wall so that all the walls can be connected along the edges of the base plate 1, defining a space above the base plate 1 as shown in FIGS. 1 and 2. It is understood that the protrusions may be configured on the front and back walls and the apertures may be configured on the side walls. In preferred embodiments, the apertures 203 are circular bores through the back wall 2 with a diameter of about 5.54 millimeters.

It is understood that there may be more walls that are connected using similar mechanisms.

Two support members 6 and 7 may be provided to receive the back plate 8 and the shelving plates 9, 10, 11 and 12. The two support members 6 and 7 are removably connected to the base plate 1 and extending upwardly from the base plate 1. The two support members 6 and 7 may be removably connected to the base plate using any suitable means known in the field. In preferred embodiments, at least the bottom edges 605 and 705 are configured with protrusions 602 and 702 to be removably plugged into corresponding apertures 101 in the base plate 1. Preferably, the two support members 6 and 7 are substantially parallel to each other when connected to the base plate 1. In preferred embodiments, the lengths of the bottom edges 605 and 705 are about 210 millimeters.

In some embodiments, the back plate 8 as connected to the support members 6 and 7 may be substantially perpendicular to the bottom edges 605 and 705 of the support members 6 and 7. In some embodiments, the back plate 8 as connected is slanted so that the top edge of the back plate 8 is closer to the back edges 603 and 703 than the bottom edge of the back plate 8.

When connected to the two support members 6 and 7, the shelving plates 9, 10, and 11 are positioned at different height, i.e., they are of different distances from the bottom edges 605 and 705 of the support members 6 and 7. The shelving plates 9, 10, and 11 as connected are of different distances from the back edges 603 and 703 of the support members 6 and 7. Preferably, the higher shelving plate is closer to the back edges 603 and 703 of the support members 6 and 7. Preferably the back edge of a lower shelving plate is closer to the front edges 604 and 704 of the support members 6 and 7 than the front edge of the higher shelving plates.

In preferred embodiments, at least one of the shelving plates 9, 10 and 11 is slanted, so that the edge of the slanted shelving plate farther away from the back edges 603 and 703 of the support members 6 and 7 is higher than the edge of the slated shelving plate close to the back edges 603 and 703. This way, the upper portion of objects displayed on the slanted shelving plate may be supported by the shelving plate that is higher than and next to the slanted shelving plate. For example, the upper portion of the items displayed on shelving plate 11 may be supported by the shelving plate 10. The slanted shelving plate may be disposed at a degree between 3-40 degrees, preferably 3-30 degrees, more preferably 3-15 degrees, even more preferably 3-10 degrees, and most preferably 4.5 degrees, relative to the base plate 1. Preferably, the back plate 8 is perpendicular to the highest shelving plate 9. In preferred embodiments, the back edges 603 and 703 are about 160 millimeters long. In some embodiments, the front edge of the next higher plate has contours, recesses and/or apertures configured to receive vape products.

In some embodiments, the shelving plates 9 and 10 may have contours, recesses or apertures to receive an upper portion of the vape products placed on plates 10 and 11, respectively.

It is understood that the back plate 8 and the shelving plates 9, 10, 11 and 12 may be removably connected to the support members 6 and 7 by any suitable means known in the field. In preferred embodiments, the support members 6 and 7 are configured with apertures 601 and 701, and the back plate 8 and the shelving plates 9, 10, 11 and 12 are configured with protrusions 801, 901, 1001, 1101 and 1201, which are configured to be removably plugged into the apertures 601 and 701. In preferred embodiments, the protrusions extend about 3.66 millimeters from the plates and are about 4.95 millimeters wide.

The protrusions 801 are preferably symmetrical relative to the center line in the length and the width directions of the back plate 8. The two edges of back plate 8 without protrusions 801 configured there on are the upper and lower edges of the back plate 8 relative to the base plate 1. Preferably, the back plate 8 is symmetrical, and the upper and lower edges of the back plate 8 are identical.

The protrusions are preferably symmetrical relative to the center line in the length and the width directions of the shelving plates 9, 10 and 11. The two edges of each of shelving plates 9, 10 and 11 that do not have protrusions configured thereon are the front and back edges of the shelving plates 9, 10 and 11, wherein the front edge is the edge closer to the front edges 604 and 704 of the support members 6 and 7. Preferably, the shelving plates 9, 10 and 11 are symmetrical and the front edge is the same as the back edge for each of the shelving plates 9, 10 and 11. In preferred embodiments, the apertures 601 and 701 for receiving the protrusions 1001 and 1101 close to the front edge of the shelving plates 10 and 11 are higher than the apertures 601 and 701 for receiving the protrusions 1001 and 1101 close to the back edge of the shelving plates 10 and 11. In preferred embodiments, the distance between the centers of the two apertures farthest away from each other for receiving the same shelving plate is about 30 millimeters.

In preferred embodiments, the back plate 8 and the shelving plates 9, 10 and 11 are interchangeable to each other.

The shelving plate 12 may be removably connected to the support members 6 and 7 at a position closer to the front edges 604 and 704 of the support members 6 and 7 than the shelving plates 9, 10 and 11. The shelving plate 12 may be connected at any suitable height from the bottom edges 605 and 705 of the support members 6 and 7. Preferably, the shelving plate 12 is positioned between the height of the shelving plates 10 and 11. An advantage is that the shelving plate 12 may prevent items displayed on the shelving plate 11 to fall forward.

Preferably, the shelving plate 12 is configured with apertures to receive and hold the objects to be displayed and/or stored. The apertures may be of various shapes or combinations of shapes. For example, some of the apertures may be rectangular or square and some of the apertures may be circular. The rectangular or square apertures may be configured in a manner that the sides are not parallel to the sides of the shelving plate 12.

Preferably, the front edges and back edges of the shelving plates 9, 10, 11 and 12 may be substantially parallel to the base plate 1. In preferred embodiments, the plate 12 is about 150 millimeters long, 60 millimeters wide and 4.76 millimeters thick. The apertures configured on the shelving plate 12 may be square, circular and/or any other suitable shapes. In preferred embodiments, the circular apertures are circular bores through the shelving plate 12 with a diameter of about 9 millimeters. In preferred embodiments, the square apertures are square bores through the plate and each side of the square is about 7 millimeters long. In preferred embodiments, two rows of square apertures are disposed along the length of the shelving plate 12, with the square apertures in one row offset from the square apertures in the other row. In preferred embodiments, the distance between the centers of the adjacent square apertures is about 30 millimeters.

After the system is assembled, items of different sizes and shapes may be displayed and stored in the system as shown in FIG. 4.

Figure 5:
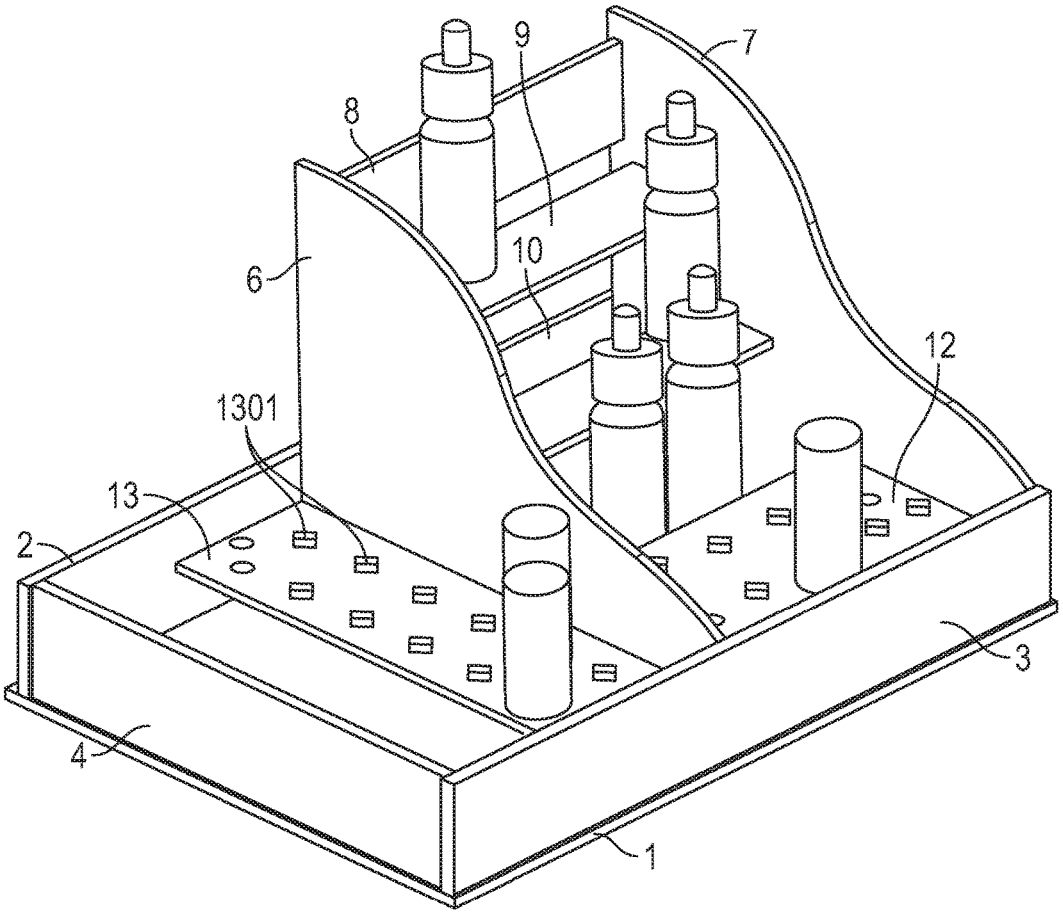
FIG. 5 is another embodiment of the system.
Figure 5A:
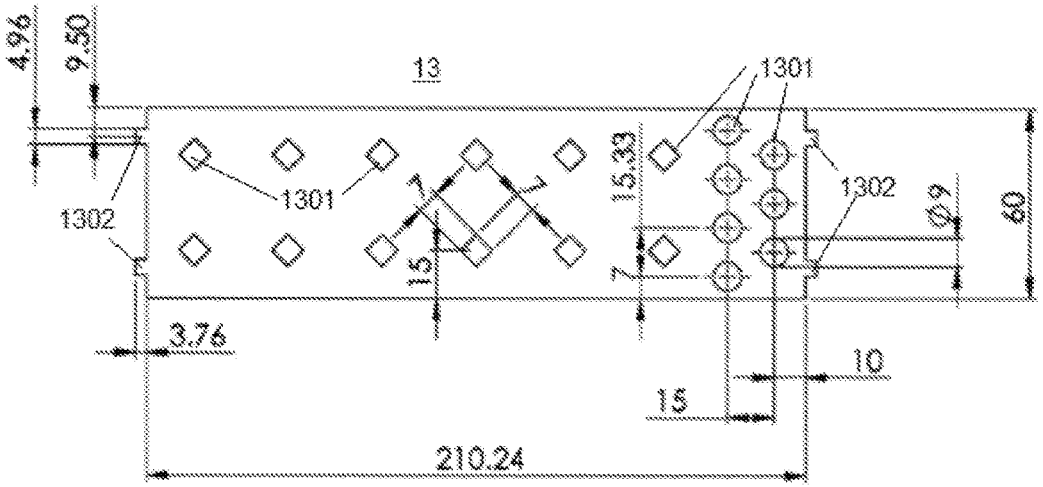
FIG. 5A is a detailed view of the side shelving plate.
Figure 6:
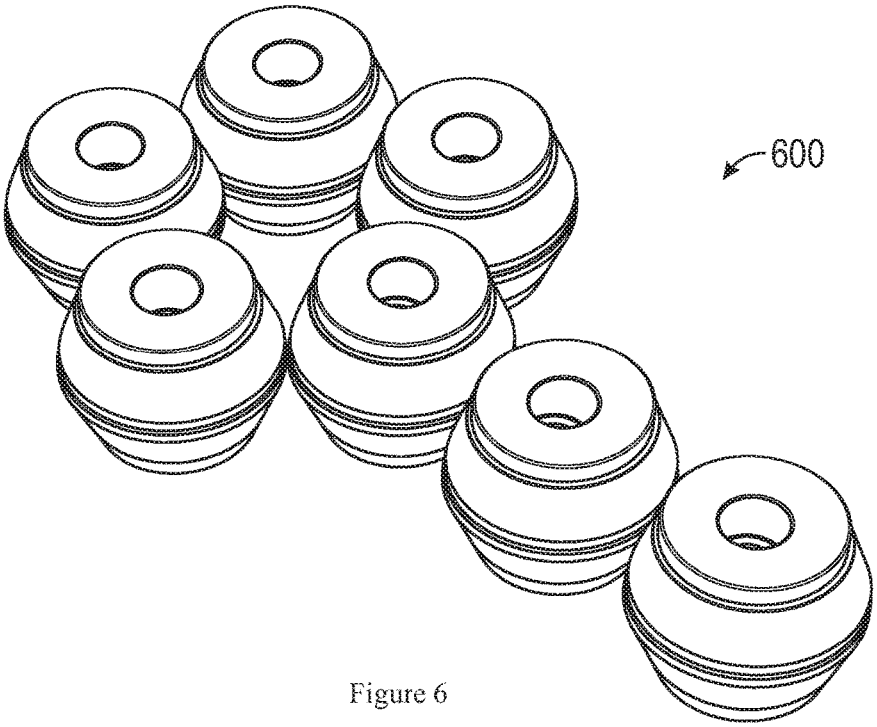
FIG. 6 shows inserts adapted to store the atomizers on the shelf.
Figure 6A:
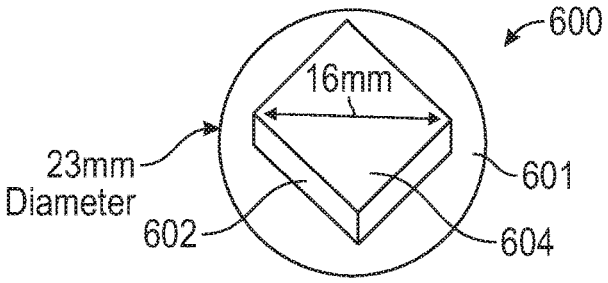
FIG. 6A is a bottom view of the insert of FIG. 6.
Figure 6B:
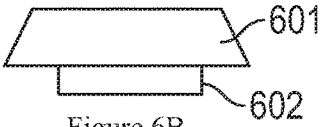
FIG. 6B is a side view of the insert of FIG. 6.
Figure 6C:
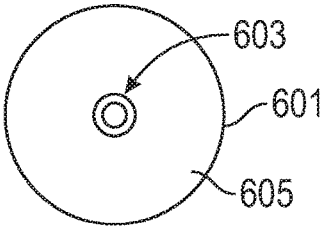
FIG. 6C is a top view of the insert of FIG. 6.

FIG. 5 shows another embodiment of the invention. In this embodiment, at least one side shelving plate 13 is removably connected to the front and back walls 3 and 2. The side shelving plate 13 may be substantially parallel to the base plate 1 when installed. The shelving plate 13 may be slanted so that items displayed and/or stored thereon may be partially supported by the support member 6. Preferably, the shelving plate 13 may be configured with apertures 1301 to receive and hold items for display and/or storage, as shown in FIG. 5A. The apertures configured on the shelving plate 13 may be square, circular and/or any other suitable shapes. In preferred embodiments, the side shelving plate is about 210 millimeters long, 60 millimeters wide and 4.76 millimeters thick. In preferred embodiments, the circular apertures are circular bores through the shelving plate 13 with a diameter of about 9 millimeters. In preferred embodiments, the square apertures are square bores through the plate 13 and each side of the square is about 7 millimeters long. It is understood that the apertures may be arranged in any suitable pattern.

It is understood that the shelving plate 13 may be removably connected to the front and back walls 3 and 2 or the support member 6 by any suitable means known in the field. In preferred embodiments, the shelving plate 13 is configured with protrusions 1302 extending from the two longitudinal ends of plate 13 and the front and back walls are configured with apertures 204 for receiving the protrusions as shown in FIG. 3A. In preferred embodiments, the protrusions 1302 extend about 3.76 millimeters from the shelving plate and are about 4.95 millimeters wide, while the apertures 204 are circular bores through the walls with a diameter of about 5.54 millimeters. In preferred embodiments, the distance between the support members 6 and 7 is the same as the distance between the front and back walls 3 and 2 and the side shelving plate 13 may be interchangeable with the shelving plate 12.

In some embodiments, specially designed inserts 600 are provided for adapting atomizers for storage on the shelf.

Insert 600 has a top portion 601 and a bottom portion 602. The bottom portion is designed to fit snugly within the apertures in the shelving plate 12 and/or 13. The top portion may be configured in any shape suitable to receive the atomizers.

In preferred embodiments, the shelving plates 12 and 13 have square apertures. Correspondingly, the bottom portion 602 may be square-prism shaped with a square bottom surface 604. In more preferred embodiments, the diagonal of the square bottom surface 604 is 16 mm and the square apertures on shelving plates 12 and 13 are sized slightly larger for fitting the bottom portion 602. In preferred embodiments, the height of the bottom portion 602 is the same as the thickness of the shelving plates 12 and 13.

In preferred embodiments, the top portion 601 may be frusto-conical, with the diameters decreasing away from the bottom portion. In preferred embodiments, the largest diameter of the top portion 601 is 23 mm. The top portion 601 may also have a cylindrical portion extending away from the smaller end of the frustum. The insert 600 may have a hole 603 extending inwardly from the top surface 605 of the top portion 601. The hole 603 may be cylindrical and extend substantially perpendicularly to the top surface 605. The hole 603 may be concentric with the top surface 605. The depth of the hole may be designed to receive an atomizer. In preferred embodiments, the hole 603 has inner thread extending at least a portion of the depth of the hole 603. In more preferred embodiments, the inner thread is 510 thread. It is appreciated that the hole 603 may be of different depth and size to accommodate other items.

It is appreciated that there may be more than one shelving plate extending from the support member 6 away from the support member 7.

Figure 7A:
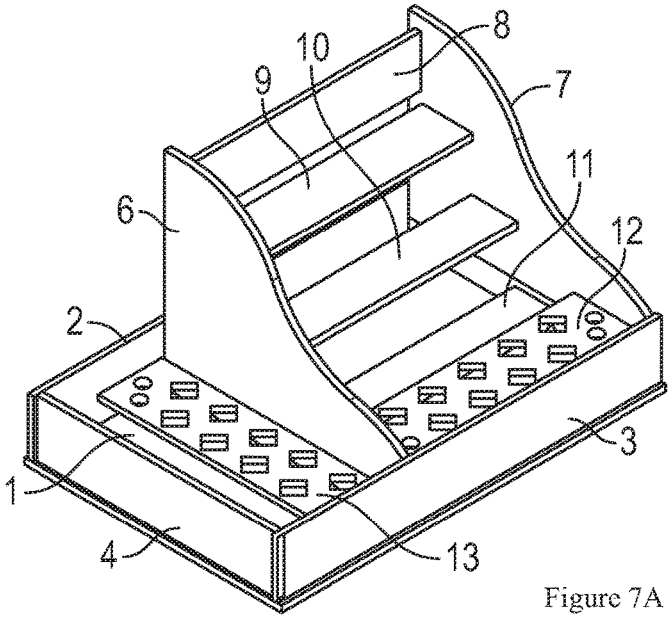
FIG. 7A shows a left side perspective view of yet another embodiment of the system.
Figure 6A:
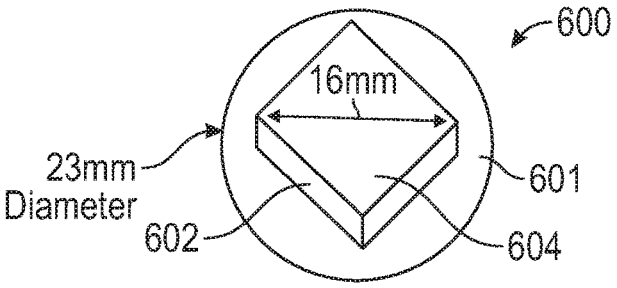
Figure 6B:
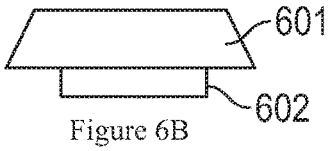
Figure 6C:
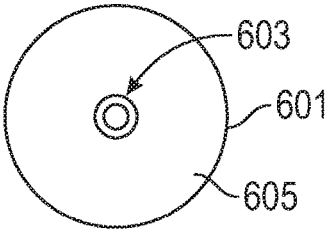
Figure 7A:
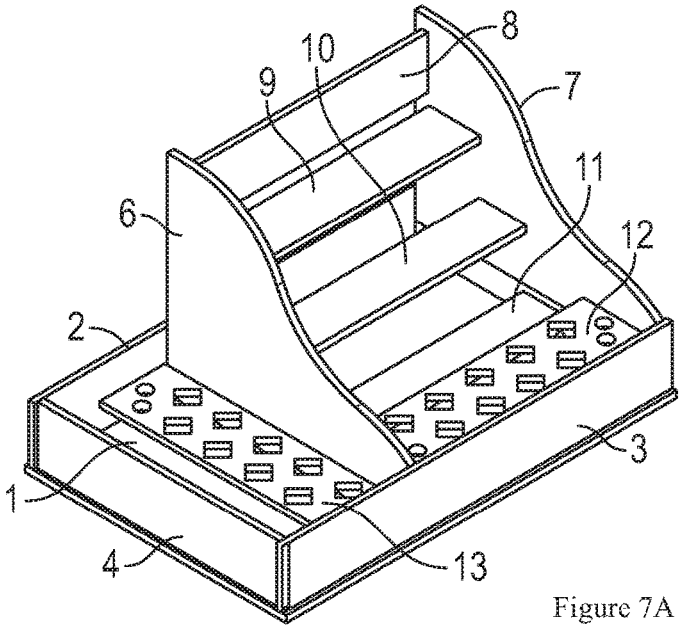
Figure 7B:
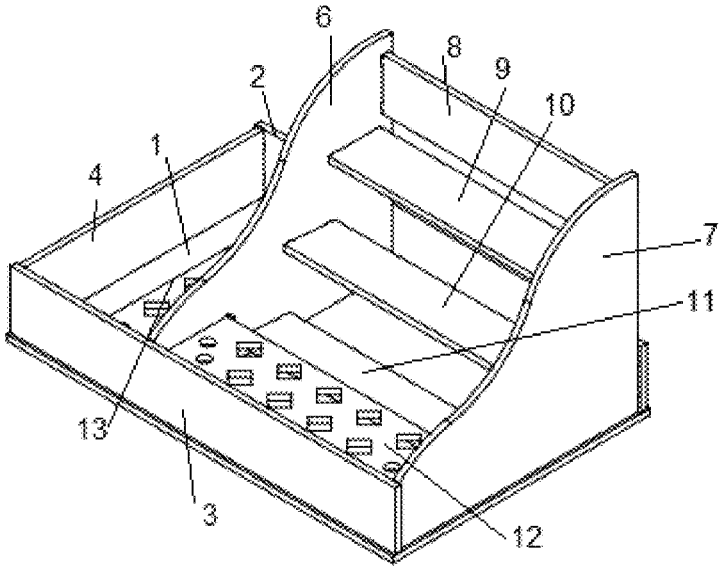
FIG. 7B shows a right side perspective view of the embodiment of FIG. 7A.
Figure 8A:
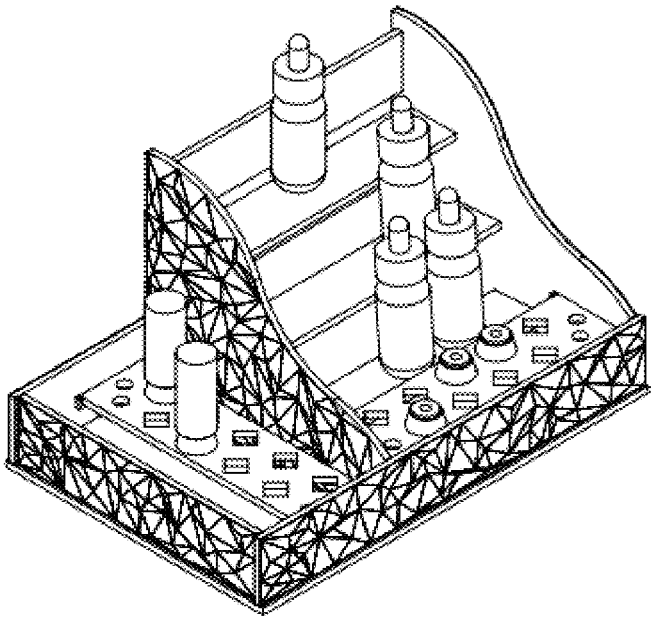
FIG. 8A shows a left side perspective view of the embodiment of FIGS. 7A, with vape products and accessories displayed thereon.
Figure 8B:
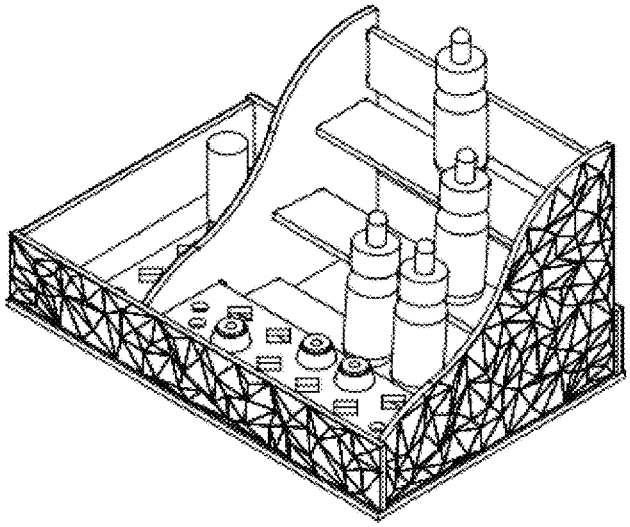
FIG. 8B shows a right side perspective view of the embodiment of FIGS. 7A, with vape products and accessories displayed thereon.

Reference is now made to FIGS. 7A and 7B, which shows yet another embodiment of the system. FIGS. 8A and 8B illustrate the system with vaping products and inserts as described above stored thereon.

This embodiment is substantially the same as the embodiments described above, except that there is no side wall 5. Rather, the support member 7 also functions as a side wall.

Figure 10:
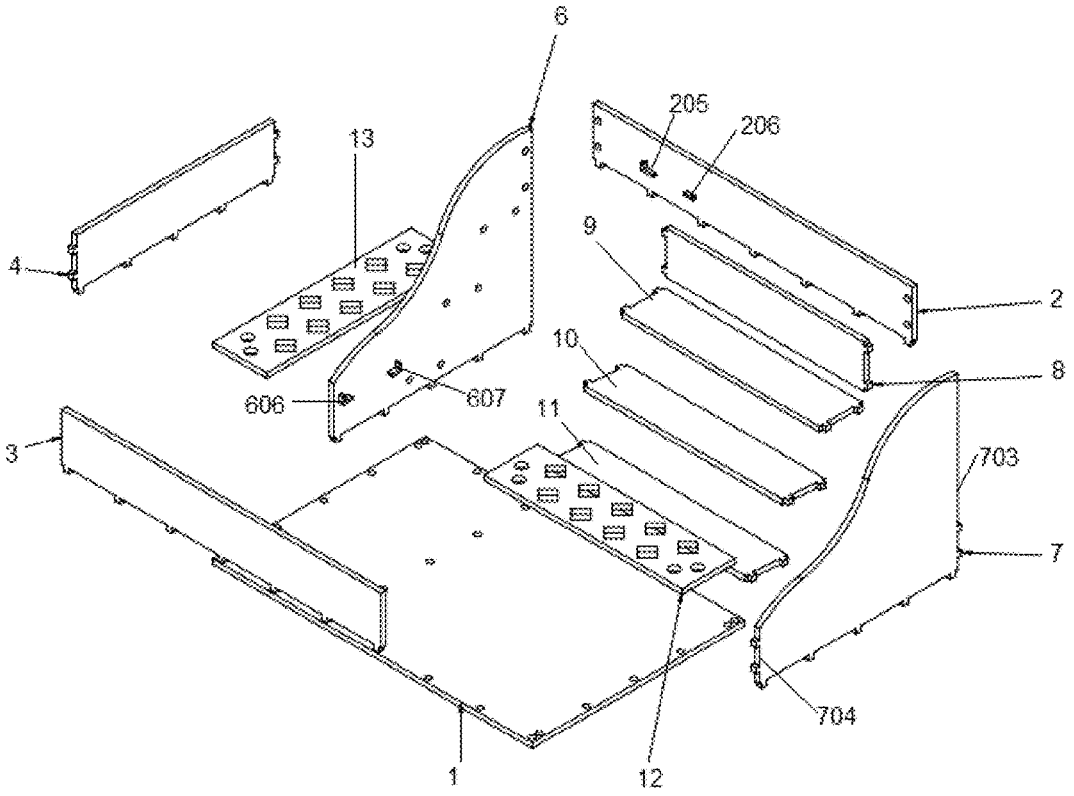
FIG. 10 is an exploded view of the embodiment of FIGS. 7A.
Figure 10A:
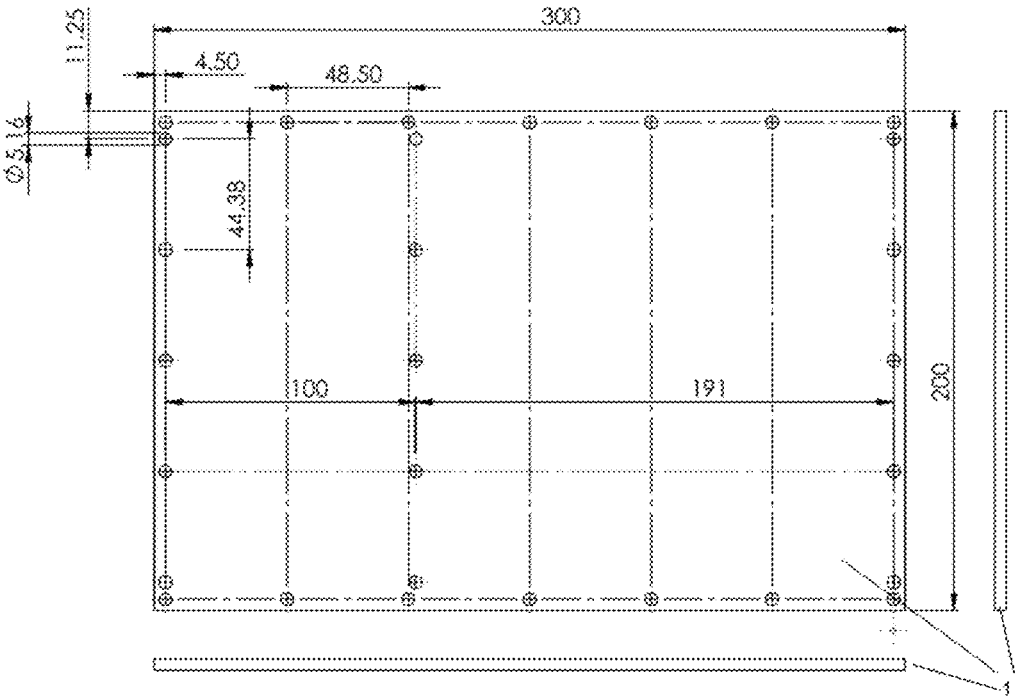
FIG. 10A shows the top view and side views of the bottom plate 1 of the embodiment of FIG. 10.
Figure 10B:
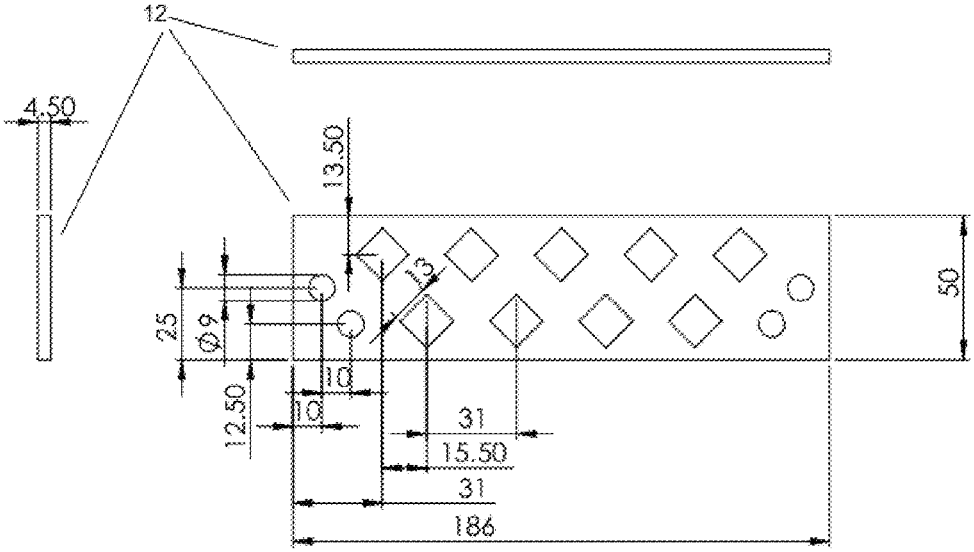
FIG. 10B shows the top plan view and side views of one of the shelving plate with apertures of the embodiment of FIG. 10.

The support member 7 may have connection means to the front and back walls 3 and 2. For example, the support member 7 may have protrusions on the front and back edges 704 and 703 for insertion into corresponding recesses on the front and back walls 3 and 2 so that the support member 7 is connected to the front and back walls 3 and 2, as shown in FIG. 10.

Figure 10C:
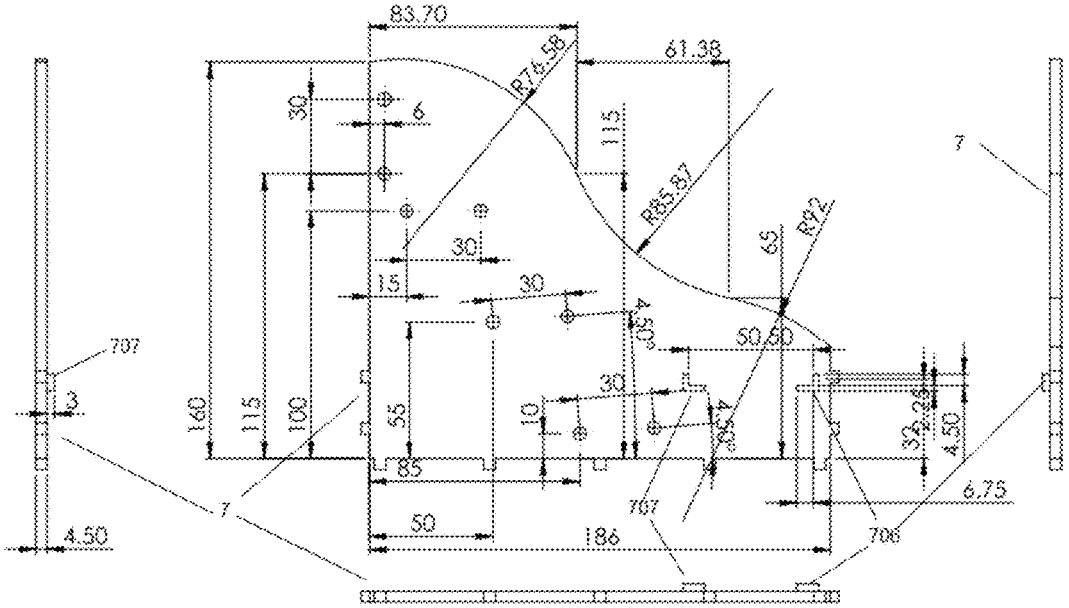
FIG. 10C shows the top plan view and side views of one support member of the embodiment of FIG. 10.
Figure 10D:
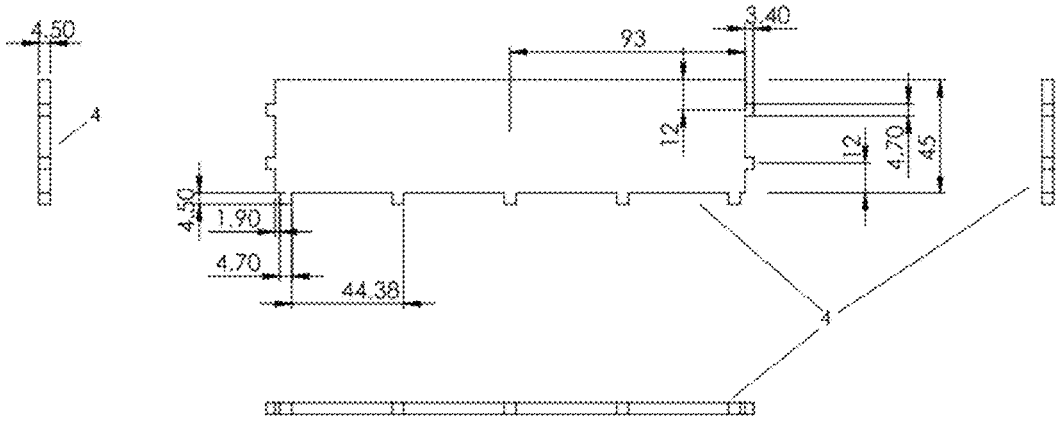
FIG. 10D shows the top plan view and side views of one side wall of the embodiment of the embodiment of FIG. 10.
Figure 10E:
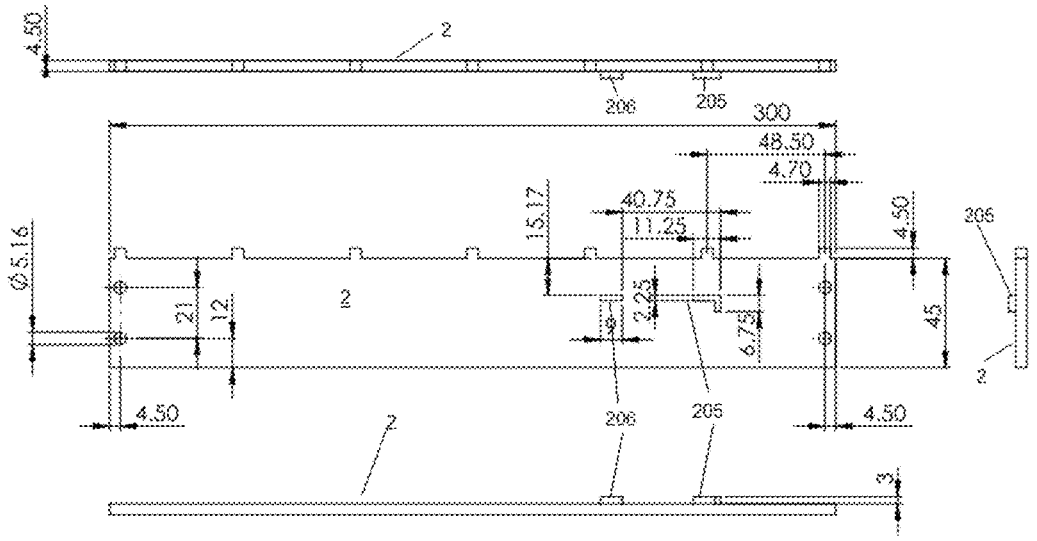
FIG. 10E shows the top plan view and side views of the back wall of the embodiment of FIG. 10.
Figure 10F:
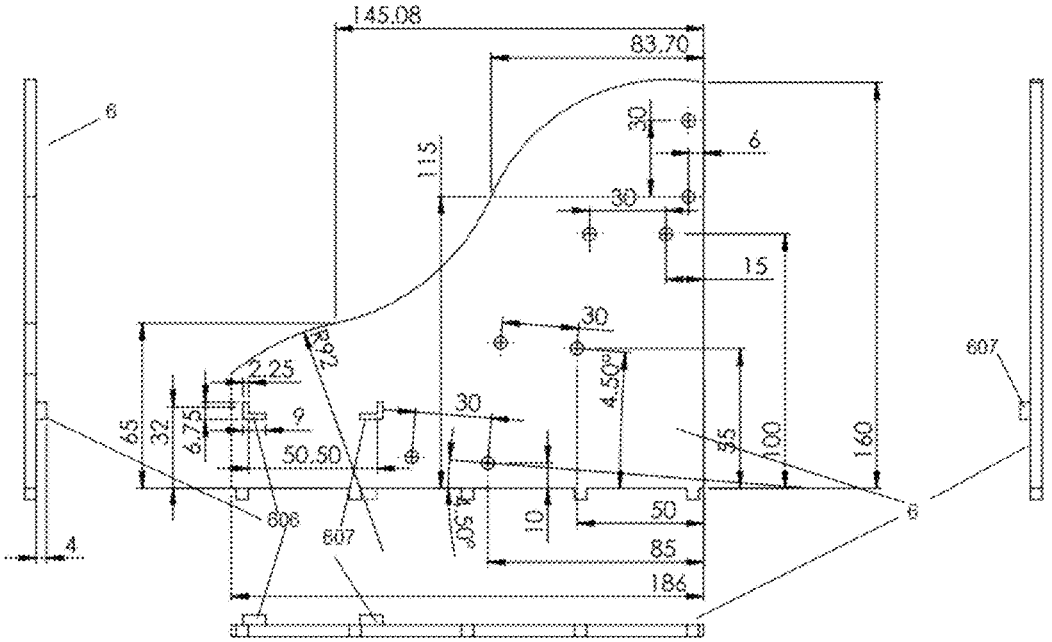
FIG. 10F shows the top plan view and side views of another support member of the embodiment of FIG. 10.
Figure 10G:
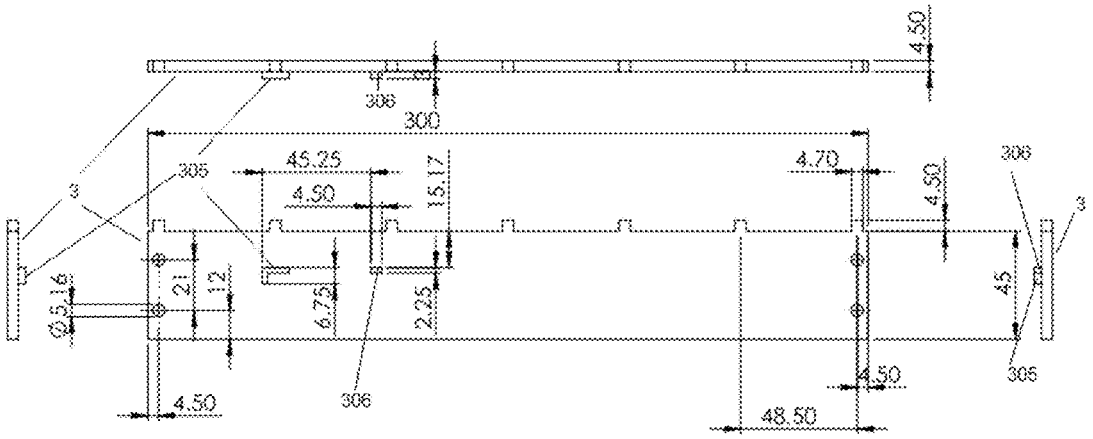
FIG. 10G shows the top plan view and side views the front wall of the embodiment of FIG. 10.

In some embodiments, the shelving plates may be connected to the support members and the walls in a more easily removable manner. For example, the support member 6 may have supporting protrusions 606 and 607 that are capable of supporting the shelving plates, in cooperation with corresponding supporting protrusions 706 and 707 on support member 7 as shown in FIG. 10C. Similarly, the back wall may have supporting protrusions 205 and 206 that can support the optional shelving plate 13, in cooperation with supporting protrusions 305 and 306 on the front wall 3, as shown in FIG. 10G. By this configuration, the shelving plates can be easily removed from the support members 6 and 7 and the walls by simply lifting the shelving plates off the protrusions.

It is appreciated that the protrusions may be any suitable shape known in the field. For example, protrusions 606 and 607 as shown in FIG. 10 have a horizontally extending portion toward each other and upwardly extending portions so that the shelving plate 12 may be supported by the horizontal portion while the horizontal movement of the shelving plate 12 is limited by the upwardly extending portions. As another example, while the protrusion 205 in FIG. 10 has a horizontally extending portion and an upwardly extending portion, protrusion 206 may have only a horizontally extending portion. The horizontal movement of the shelving plate 13 may be limited by the upwardly extending portion of the protrusion 205 and the support member 6.

Figure 9A:
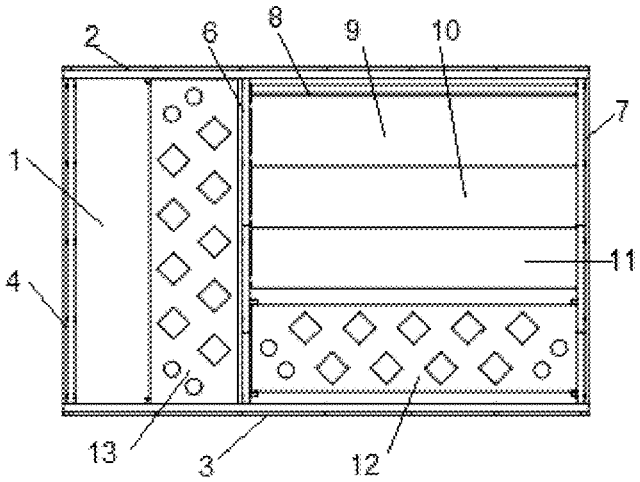
FIGS. 9A is the top plan view of the embodiment of FIGS. 7A.
Figure 9B:
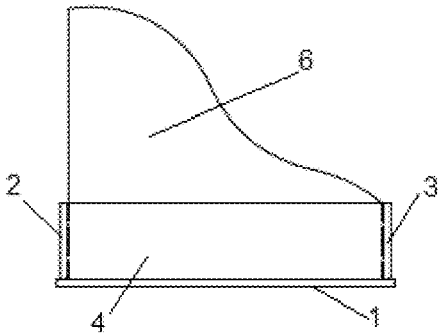
FIGS. 9B is the left elevational view of the embodiment of FIGS. 7A.
Figure 9C:
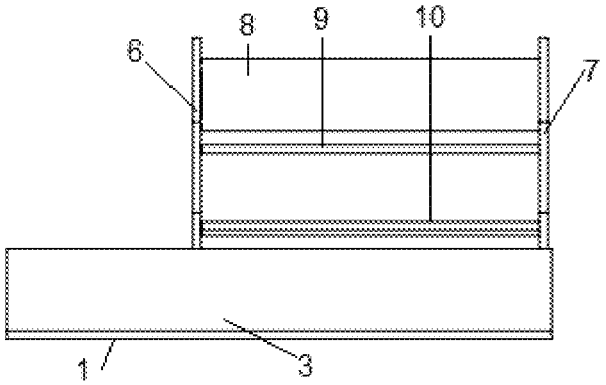
FIG. 9C is the front elevational view of the embodiment of FIGS. 7A.
Figure 9D:
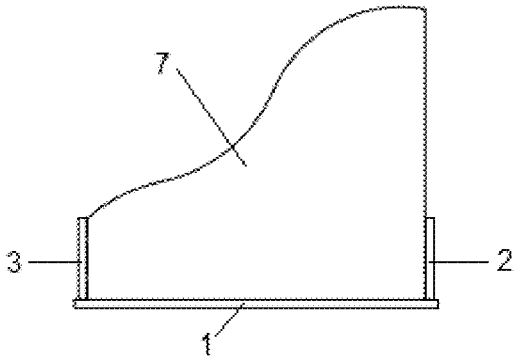
FIG. 9D is the right elevational view of the embodiment of FIGS. 7A.
Figure 9E:
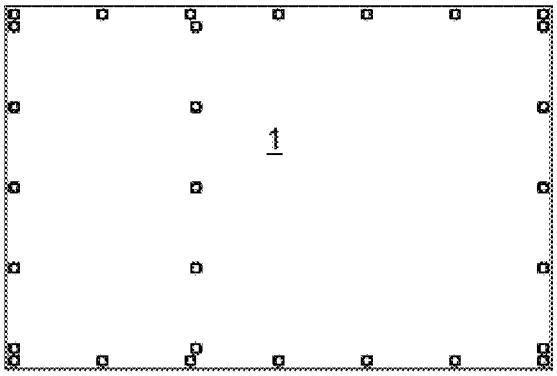
FIG. 9E is the bottom view of the embodiment of FIGS. 7A.

Corresponding to support member 7 also functioning as a side wall, the bottom plate 1 may have only one row of apertures around its edges, as shown in FIG. 9E.

It is understood that the apertures for receiving the protrusions as described herein may be recesses having depths smaller than the thicknesses of the components such recesses are configured on so that there are no visible holes on the outer surfaces of these components. For examples, there are no holes shown on the outer surfaces of the walls and the support members in FIGS. 7A, 7B, 8A, 8B, 9B-D and 11.

A method for assembling the shelving and storage system is also provided. Support member 6 or 7 may first connect to one end of the plates 8, 9, 10, 11 and 12 and the free end of the plates 8, 9, 10, 11 and 12 are connected to the other of the support members 6 and 7. The bottom edges 605 and 705 are then connected to the base plate 1.

The walls may be installed on the base plate 1 before or after connecting the bottom edges 605 and 705 to the base plate 1. If the walls are connected to each other using corresponding protrusions and apertures, the walls need to connect to each other first and then the base plate 1 is connected to the walls.

If the walls are connected to each other by the slots, then the walls may be connected to each other first and then the base plate 1 is connected to the walls. Alternatively, the walls with slots opening opposite to the protrusions may be connected to the base plate 1 and the walls with the slots opening in the same direction of the protrusions may then be connected to the base plate 1 and the installed walls.

For the embodiment that there is a side shelving plate 13, the method may be modified to accommodate the installation of the shelving plate 13. If the shelving plate 13 is installed on the support member 6, then it may be installed before or after the support members 6 and 7 are installed on the base plate 1. However, if the shelving plate 13 is installed by protrusions and the apertures on the front and back walls 3 and 2, the shelving plate 13 needs to be installed on the front and back walls 3 and 2, then the side walls may be connected to the front and back walls 3 and 2 and the connected walls may be installed on the base plate 1.

The user may disassemble the system when desired, for example, when the system needs to be transported. The base plate 1 may be removed first and the walls may then be disconnected from each other. The support members 6 and 7 may then be disconnected from the plates.

If the side shelving plate 13 is connected to the support member 6, then the shelving plate 13 may be removed before or after the walls are disconnected from each other. If the shelving plate 13 is installed on the walls, then the shelving plate 13 may be disconnected by disconnecting the walls from each other.

Afterwards, the support members are detached from the shelving plates 8, 9, 10 and 11.

The embodiments of the present disclosure described above are intended to be examples only. The present disclosure may be embodied in other specific forms. Alterations, modifications and variations to the disclosure may be made without departing from the intended scope of the present disclosure. While the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology. All references mentioned are hereby incorporated by reference in their entirety. Persons skilled in the art will appreciate that the dimensions may be adjusted where desired.

The invention claimed is:

1. A modular system for displaying and storing vaping products, comprising:

a base plate having peripheral side, front and back edges;

at least one upright wall;

at least two support members;

a plurality of shelving plates, each having shelving plate front, side and back peripheral edges; and at least one back plate;

wherein the at least one upright wall is configured to removably connect to the base plate at the back peripheral edge of the base plate and extending upwardly from the base plate;

one of the at least two support members is configured to removably connect to the side peripheral edges of the base plate, another one of the at least two support members is positioned between the peripheral side edges on opposite sides of the base plate, the at least two support members extending upwardly from the base plate, the plurality of shelving plates are configured to removably connect and extend between the at least two support members, and at least one of the plurality of shelving plates extends at an angle above a horizontal plane from front to back so that the shelving plate front peripheral edge is higher than the shelving plate back peripheral edge, and the back plate is upright and configured to removably connect between the at least two support members at a rear area thereof, such that it extends adjacent and above the shelving plate rear edge allowing vaping products to be placed on the at least one angled shelving plate and be supported by the back plate.

2. The modular system for displaying and storing vaping products of claim 1 further comprising an additional shelving plate removably positioned above said angled shelving plate and offset rearwardly from said angled shelving plate, such that vaping products resting on said angled shelving plate may rest against a front edge of said upper shelving plate.

3. The modular system as recited in claim 2 wherein the upper shelving plate front edge includes contours, recesses and/or apertures configured to receive vape products.

4. The modular system as recited in claim 3 wherein said vape products are selected from atomizers, tanks, rebuildable dripping atomizers (or RDA's), rebuildable tank atomozers (RTA's), sub-ohm tanks, clearomizers, cartomizers, ordrip tips or a combination thereof.

5. The modular system as recited in claim 1 wherein the back plate includes recessed portions and/or apertures adapted to accept portions of the vape products sitting on said angled shelving plate.

6. The modular system of claim 1 wherein the base plate is substantially rectangular.

7. The modular system of claim 1 wherein the base plate is configured with base plate apertures, and the at least one wall and the at least two support members are configured with protrusions configured to be removably received in the base plate apertures to connect the at least one wall and the at least two support members to the base plate.

8. The modular system of claim 1 wherein the at least two support members are configured with support member apertures, and the at least one back plate and the plurality of shelving plates are configured with plate protrusions configured to be removably received in the support member apertures to connect the at least one back plate and the plurality of shelving plates to the at least two support members.

* * * * *